United States Patent [19]

Smith

[11] Patent Number: 4,995,515

[45] Date of Patent: Feb. 26, 1991

[54] FINE ARTIST PAINT BRUSH REST

[76] Inventor: Timothy C. Smith, 1924 University Ave., Berkeley, Calif. 94704

[21] Appl. No.: 307,694

[22] Filed: Feb. 6, 1989

[51] Int. Cl.[5] ..... A47F 7/00

[52] U.S. Cl. ..... 211/65; 211/69.1

[58] Field of Search ..... 211/70.1, 69.1, 65

[56] References Cited

U.S. PATENT DOCUMENTS

| | | | |
|---|---|---|---|
| 712,824 | 11/1902 | Masland | 211/65 X |
| 2,664,005 | 12/1953 | Kosinski | 211/70.1 |
| 3,002,630 | 10/1961 | Fleisser | 211/65 |
| 3,270,752 | 9/1966 | Dorrance | 211/69.1 X |
| 3,429,450 | 2/1969 | Lambert | 211/69.1 |
| 4,275,818 | 6/1981 | Church | 220/90 |
| 4,352,477 | 1/1982 | Garrett et al. | 248/156 |
| 4,377,239 | 2/1983 | Jimae | 211/65 |
| 4,436,217 | 3/1984 | Ritter | 220/85 D |
| 4,494,660 | 1/1985 | Hansen | 211/69.1 |
| 4,650,069 | 3/1987 | Linton | 211/69.1 X |
| 4,770,379 | 9/1988 | Estvold | 211/65 X |

*Primary Examiner*—Robert W. Gibson, Jr.

[57] ABSTRACT

A fine artist paint brush rest (10) to be used in conjunction with a flat surface. The paint brush rest comprises a first side plane (18) and a second side plane (20) joined together at the top edges to form an extended A-frame configuration with a single bend which allows the bottom edges of each side plane to act as the base of the device (10). The paint brush rest (10) has several notches (12) removed from the apex designed to receive the uppermost portion of a fine artist paint brush (24) for the purpose of stabilizing brushes to prevent smearing of paint on unwanted areas and to protect and extend the life of the paint brush (24).

1 Claim, 3 Drawing Sheets

FINE ARTIST PAINT BRUSH REST

BACKGROUND-FIELD OF INVENTION

This invention pertains generally to supports and holders and more particularly to a device for resting fine artist paint brushes while in use.

BACKGROUND-DESCRIPTION OF PRIOR ART

During a painting operation it is frequently required that the paint brush be put down, typically in a jar or palette holding the paint. This is undesirable in that the hairs or bristles of the brush can become curled and deformed if left in a jar too long, and can roll off a palette causing paint to smear on unwanted areas.

Prior art devices have been utilized to attempt to overcome these problems. Typically the prior art devices have been mainly designed towards house painting brushes, and large brushes for use with paint cans. Prior art devices have not taken into consideration the fact that fine artist paint brushes are much smaller and are different sizes and must be at easy access to the painter at all times.

U.S. Pat. No. 4,377,239 to Jimae (1983) discloses a paint brush holder for use with paint cans. It holds the brushes with a gripping saddle. The brushes must be forced into the saddle in order to remain stable. This is undesirable because the brush could splatter paint if it were to get stuck in the saddle and had to be yanked out.

U.S. Pat. No. 4,436,217 to Ritter (1984) discloses a paint brush support which also attaches to a paint can. Brushes are placed in the holding well when not being used. This is unwanted because it allows paint to collect in the bottom of the well. This device would also deform the bristles of a fine artist paint brush.

U.S. Pat. No. 4,275,818 to Church (1981) discloses a brush holder which attaches to a paint can, and is designed for professional house painting brushes and rollers. This holder would not hold two or three small fine artist paint brushes.

U.S. Pat. No. 4,494,660 to Hansen (1985) shows a holding device for pencils and the like using a flexible mesh secured to a base. Objects extend through the openings in the mesh and are gripped by the strands which define the openings. However, this flexible mesh would not hold several paint laden brushes. Removing one item would cause the mesh to move or sway and dislodge any number of its members.

U.S. Pat. No. 3,429,450 to J. J. Lambert (1969) discloses an article holder which mounts onto the outer edge of a table or shelf and has access for only one paint brush. The brush sits in a very shallow well which makes it easy to knock the brush out if bumped. The storage holes are not designed for paint brushes. The brushes again would get deformed.

There is demonstrated need for a device which would support several fine artist paint brushes while being used, which would eliminate smearing of paint on unwanted areas and would allow easy access to brushes at all times, a device which would also act as a storage support to protect delicate paint brush hairs while not in use.

SUMMARY AND OBJECTIVES OF THE INVENTION

With the above background in mind, it is among the primary objectives of the present invention to provide a resting device designed to rest a variety of fine artist paint brushes.

In its form, the brush rest is designed so that it has an extended A-frame body with several notches cut out from along the apex of the body. These notches are used as the resting place for paint brushes.

It is a further objective of this invention to provide a device of the character described above in which paint brushes are held stable while in use so as not to smear paint on unwanted areas.

It is a further objective of this invention to provide a device of the character described above which will support paint brushes while not in use so as to protect the delicate hairs and allow brushes to retain a mandatory shape.

It is a further objective of this invention to provide a device of the character described above which is relatively immune to the effects of paint cleaning solvents such as acetone, paint thinner, paint remover, turpentine and the like.

It is a further objective of this invention to provide a device of the character described above which is relatively inexpensive to manufacture, durable in construction, and of reasonable cost.

Additional objects and features of the invention will become apparent from the following description in which the preferred embodiments are set forth in detail in conjunction with the accompanying drawings.

REFERENCE NUMERALS IN DRAWINGS

Figure 1:
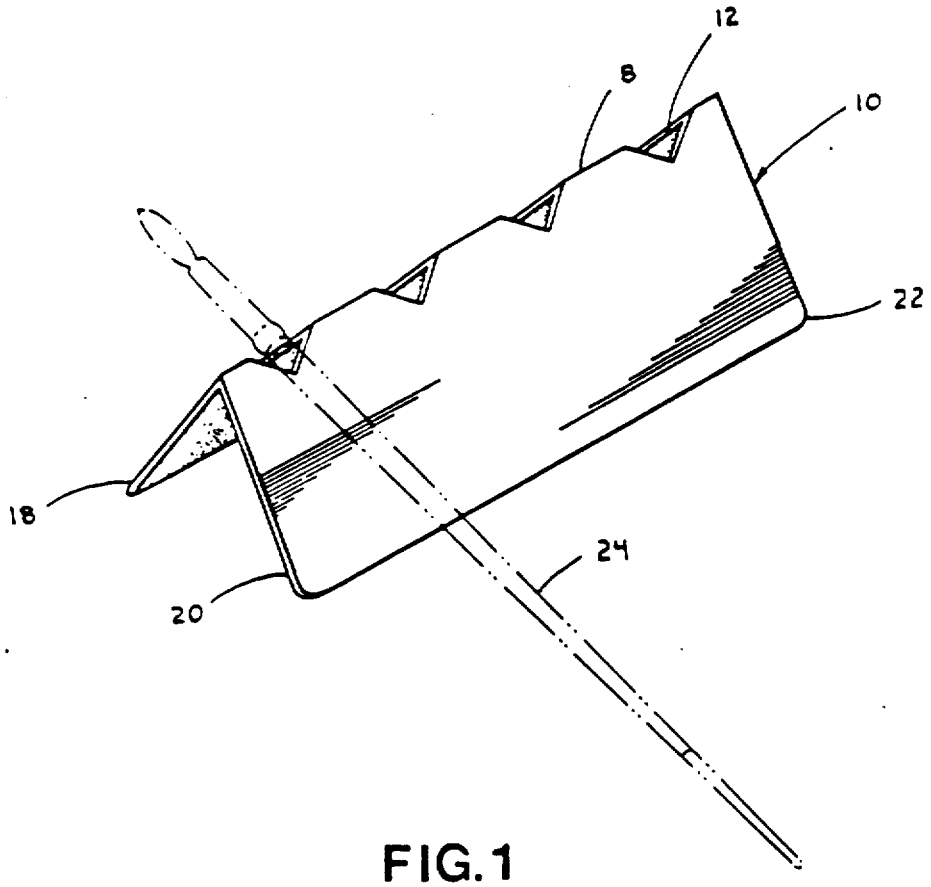
FIG. 1 is a perspective view of the paint brush rest of the invention showing how it is used with a paint brush.

8 space between notches
10 fine artist paint brush rest
12 V-shaped notch
14 U-shaped notch
16 square shaped notch
18 first side plane
20 second side
22 radiused corners
24 fine artist paint brush

DETAILED DESCRIPTION

Figure 2:
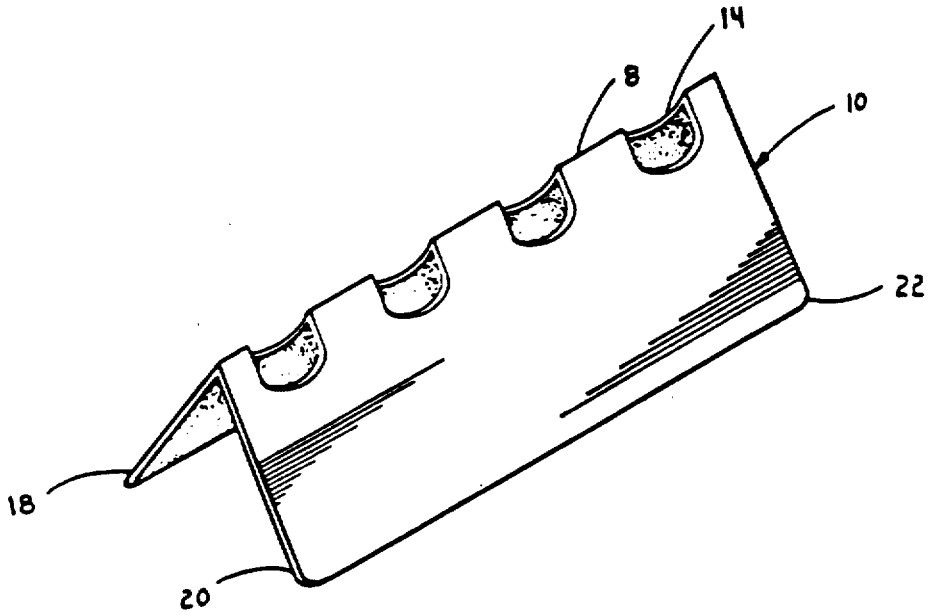
FIG. 2 is a perspective view of the paint brush rest of the invention showing an alternative shape of the notch used as the resting place for paint brushes.
Figure 3:
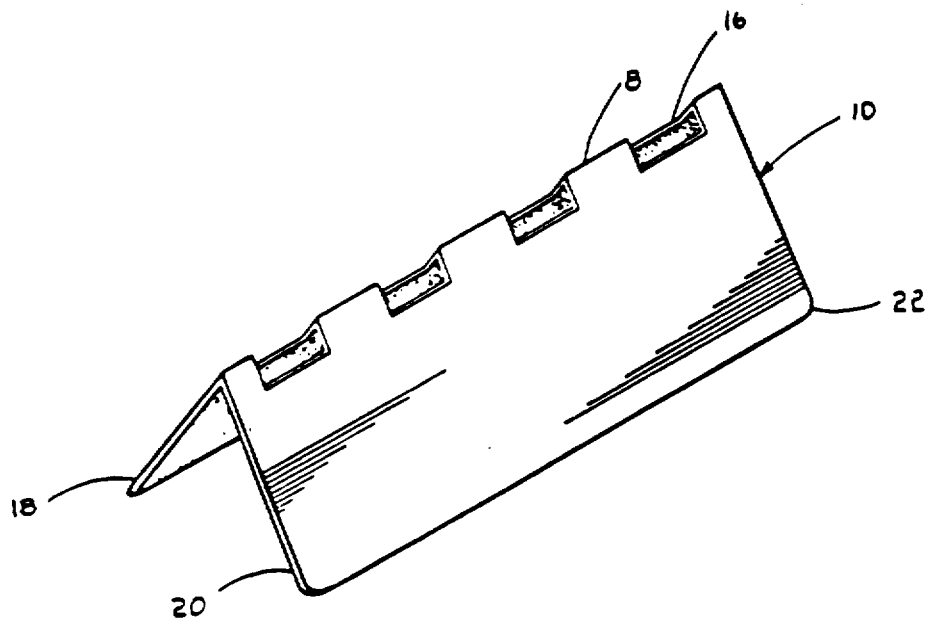
FIG. 3 is a perspective view of the paint brush rest of the invention showing another alternative shape of the notch used as the resting place for paint brushes.

The fine artist paint brush rest (10) is shown in the accompanying drawings. Its forms are shown in FIG. 1 through FIG. 3. The function of the rest is to temporarily support fine artist paint brushes.

The resting device (10) in FIG. 1 has a first side plane (18) and a second side plane (20) joined together at the top to form an extended A-frame configuration (10). FIG. 1 includes several notches (12) equally spaced (8) across the distance of the apex of the device (10). The corners (22) of the device have been radiused to eliminate any sharp edges for the promotion of safety.

The resting device (10) in FIG. 1 can be modified in a number of ways without detracting from the general use and operation of the device. FIG. 2 shows the device with a notch (14) of a different shape. FIG. 3 shows the device with a notch (16) of another different shape.

The notches (12) in all figures are used as the resting place for fine artist paint brushes (24).

The resting device (10) is placed upon a flat surface and the uppermost portion of the paint brush (24) is placed in one of the notches (12) FIG. 1. A separate paint brush can be set into each notch (12). The paint brush (24) will rest in the notch (12) without sliding out due to the small size of the device (10) and the low angle which is produced when a paint brush (24) is set in place.

The resting device (10) is formed of a single unitary member of conventional commercially available material such as metal, plastic, or the like, but has been found to be economic to manufacture the paint brush rest as a single integral member made of aluminum.

In this way the resting device (10) has no clamps or separate attachments for holding paint brushes (24) in place. The paint brush (24) can be removed in a quick and easy fashion merely by picking up the instrument.

It is to be understood that the drawings are simply for the purpose of illustration and that such changes in design and structure of the brush rest may be made as do not depart from the spirit and scope of the invention as described in the specification and particularly defined in the appended claims.

CONCLUSION, RAMIFICATIONS AND SCOPE OF INVENTION

Thus the reader will see that the fine artist paint brush rest of the invention provides a highly reliable, lightweight, yet economical device which is safe and can be used by persons of almost any age.

While my above description contains many specificities, these should not be construed as limitations on the scope of the invention, but rather as an exemplification of one preferred embodiment thereof. Many other variations are possible. For example. The aluminum brush rest could have an electro-plated finish in a variety of colors. The brush rest could have one side shorter than the other which would change the slope the paint brush would have while still allowing the device to function properly.

Accordingly, the scope of the invention should be determined not by the embodiments illustrated, but by the appended claims and their legal equivalents.

I claim:

1. A fine artist paint brush rest made from a single blank of stamped, formed, thin durable aluminum comprising:

an extended A-frame configuration having a single bend therein, said bend forms the apex of said A-frame, a first side of said A-frame comprising a plane having an upper edge and a lower edge, a second side of said A-frame having an upper edge and a lower edge, the two upper edges joined at said single bend, a plurality of notches located along the length of said single bend, said notches extending partially down each side of said A-frame, said lower edges resting on a support surface to provide a means for supporting a plurality of paint brushes in said notches.

* * * * *